US011832706B1

(12) United States Patent
Liu

(10) Patent No.: US 11,832,706 B1
(45) Date of Patent: Dec. 5, 2023

(54) METAL APPLICATION HEAD DEVICE OF COSMETIC CONTAINER

(71) Applicant: Zhuhai Ding Rong Plastic Products Co., LTD., Zhuhai (CN)

(72) Inventor: Ting Nan Liu, New Taipei (TW)

(73) Assignee: Zhuhai Ding Rong Plastic Products Co., LTD., Zhuhai (CN)

( * ) Notice: Subject to any disclaimer, the term of this patent is extended or adjusted under 35 U.S.C. 154(b) by 0 days.

(21) Appl. No.: 17/963,259

(22) Filed: Oct. 11, 2022

(51) Int. Cl.
*A45D 34/04* (2006.01)

(52) U.S. Cl.
CPC ..... *A45D 34/04* (2013.01); *A45D 2200/055* (2013.01); *A45D 2200/10* (2013.01)

(58) Field of Classification Search
CPC ..... A45D 34/04; A45D 2200/10; A45D 2200/055; A45D 40/26; A45D 2200/15; A45D 2200/155; A45D 2200/20
USPC ..... 401/261–263, 265, 266, 269
See application file for complete search history.

(56) References Cited

U.S. PATENT DOCUMENTS 3,400,997 A * 9/1968 Schwartzman ..... B65D 47/42 401/265
9,277,798 B2 * 3/2016 Moreau ..... A61M 35/003
10,617,193 B2 * 4/2020 Thorpe ..... A61M 35/003

* cited by examiner

*Primary Examiner* — David J Walczak

(57) ABSTRACT

A metal application head device of a cosmetic container includes a hollow, metal application head including a positioning rod; a plastic discharging unit including joining, discharging and fastening sections in which the joining section is in the application head and includes a through hole, a positioning opening communicating with the through hole, and a shoulder; the discharging section includes an axial channel and a transverse outlet; the fastening section includes a bossed hole, and the positioning rod passes through the through hole with the urging surface urging against the shoulder; and a plunger including an intermediate, annular flange; a hollow, cylindrical, front extension in the bossed hole; an axial tunnel through the plunger, and a spring biased cylindrical, rear extension; a sleeve including a cylindrical member, an internal space with the rear extension disposed therein, and a rear extending member having at least one transverse inlet.

14 Claims, 10 Drawing Sheets

METAL APPLICATION HEAD DEVICE OF COSMETIC CONTAINER

FIELD OF THE INVENTION

The invention relates to application heads and more particularly to a metal application head device of cosmetic container.

BACKGROUND OF THE INVENTION

Conventionally, an application head device is secured to a cosmetic container so as to communicate with inside of the cosmetic container. Thus, a cosmetic liquid in the cosmetic container can flow to the application head device prior to being discharged. The application head device includes a joining section and a discharging section both made of the same material such as plastic, ceramic or metal. Regarding plastic, consumers may view the product as cheap and inferior. Regarding ceramic or metal, the application head device and the cosmetic container may be not precisely fastened together due to limitations of manufacturing processes.

For overcoming the above drawback, there is a type of cosmetic container commercially available. An application head device of the cosmetic container has a discharging section made of metal involved powder metallurgy and a joining section made of plastic. The discharging section and the joining section are joined by means of two times of injection molding. However, the metal discharging section involved powder metallurgy and the plastic joining section cannot join completely. As a result, the joining section has an uneven surface and is subject to breakage due to insufficient tension.

Thus, the need for improvement still exists.

SUMMARY OF THE INVENTION

It is therefore one object of the invention to provide a metal application head device of a cosmetic container comprising a metal application head is formed by punching a metal sheet, including an internal space, a positioning rod at an inner end, an enlargement at an end of the positioning rod, and an urging surface between the positioning rod and the enlargement; a plastic discharging unit formed integrally, the discharging unit including a joining section, a discharging section; and a fastening section wherein the joining section is fitted in the internal space of the application head and includes a through hole through a top, a positioning opening under the through hole and communicating with the through hole, and a shoulder between the positioning opening and the through hole; the discharging section includes an axial channel and a transverse outlet communicating with the axial channel; the fastening section includes an internal bossed hole; and the positioning rod passes through the through hole with the urging surface urging against the shoulder; a plunger including an intermediate, annular flange, a hollow; cylindrical, front extension disposed in the bossed hole, an axial tunnel through the plunger and communicating with the axial channel, and a cylindrical, rear extension; a sleeve including a cylindrical member having a front rim extending outward and urging against both the fastening section and the intermediate, annular flange, an internal space disposed in the cylindrical member with the rear extension disposed therein, and a rear extending member having at least one transverse inlet; and a biasing member disposed on the rear extension.

The invention has the following advantages and benefits in comparison with the conventional art:

The positioning rod of the application head passes through the through hole of the discharging unit with the annular, inclined surface urging against the shoulder. The concave member is complimentarily secured to the shoulder member so that the application head and the discharging unit are fastened together. The application head having the internal space is formed by punching a metal sheet, Size of the application head is more precise so that a perfect fit between the application head and the discharging unit is made possible.

The application head device can be mounted in a cosmetic container including a container containing cosmetic liquid and a cap. The cosmetic liquid can be uniformly, constantly discharged out of the container by means of the plunger, the sleeve, and the torsion spring, Leaking of the cosmetic liquid out of the container is prevented in a storage configuration of the cosmetic container. The transverse outlet is transversely provided in the discharging unit so that the discharged cosmetic liquid can be applied to increased area of the body part.

The above and other objects, features and advantages of the invention will become apparent from the following detailed description taken with the accompanying drawings

DETAILED DESCRIPTION OF THE INVENTION

Figure 1:
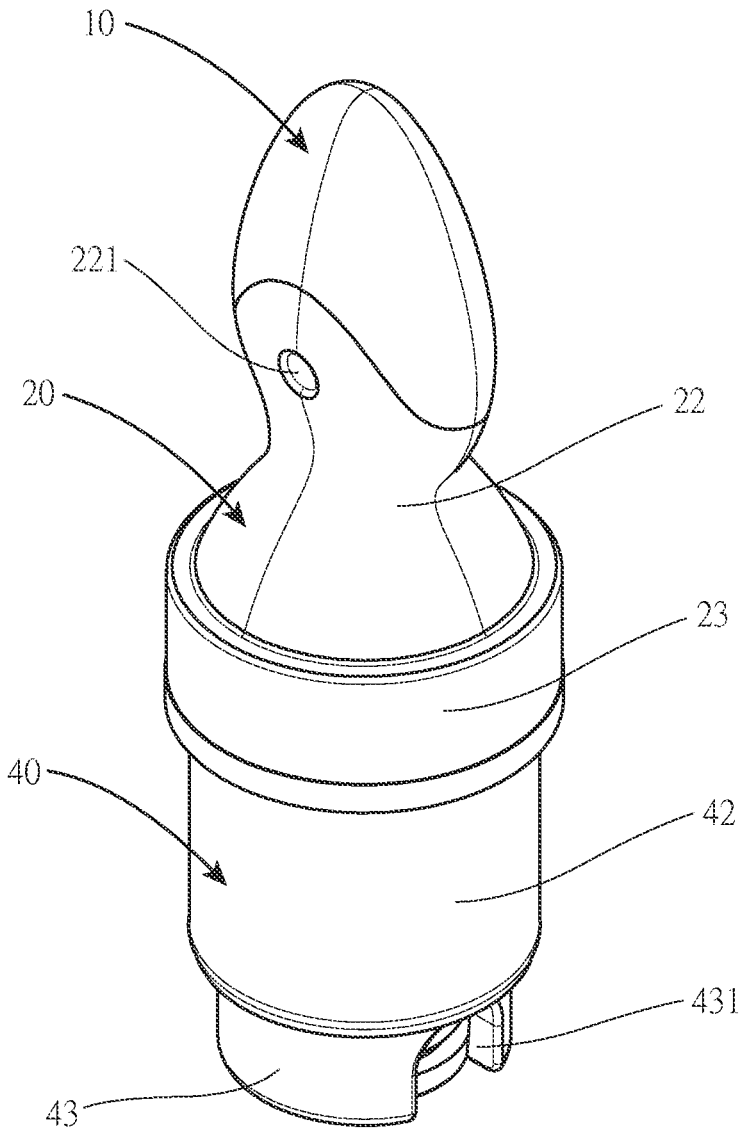
FIG. 1 is a perspective view of a metal application head device of a cosmetic container according to a first preferred embodiment of the invention.
Figure 2:
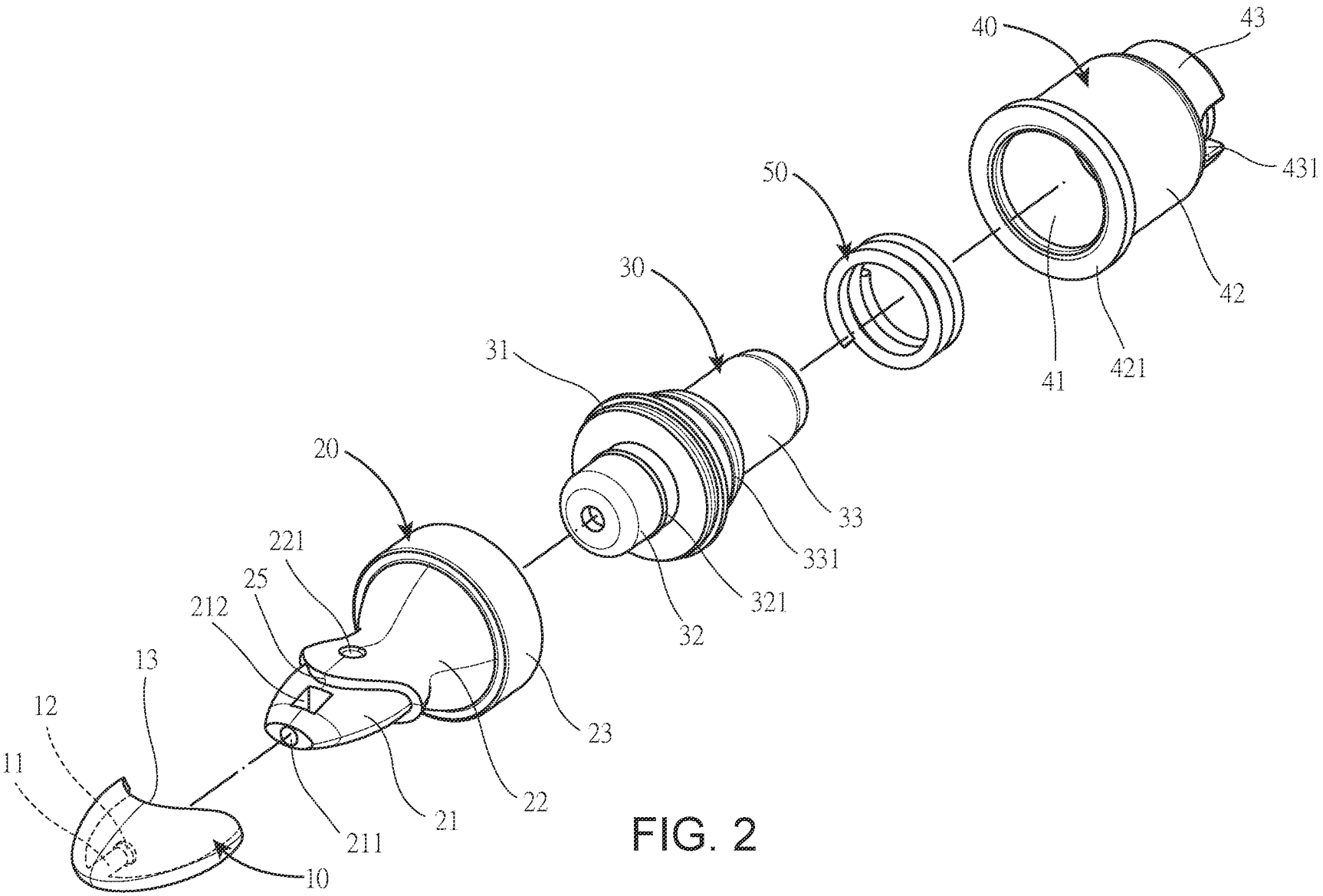
FIG. 2 is an exploded view of the metal application head device.
Figure 3:
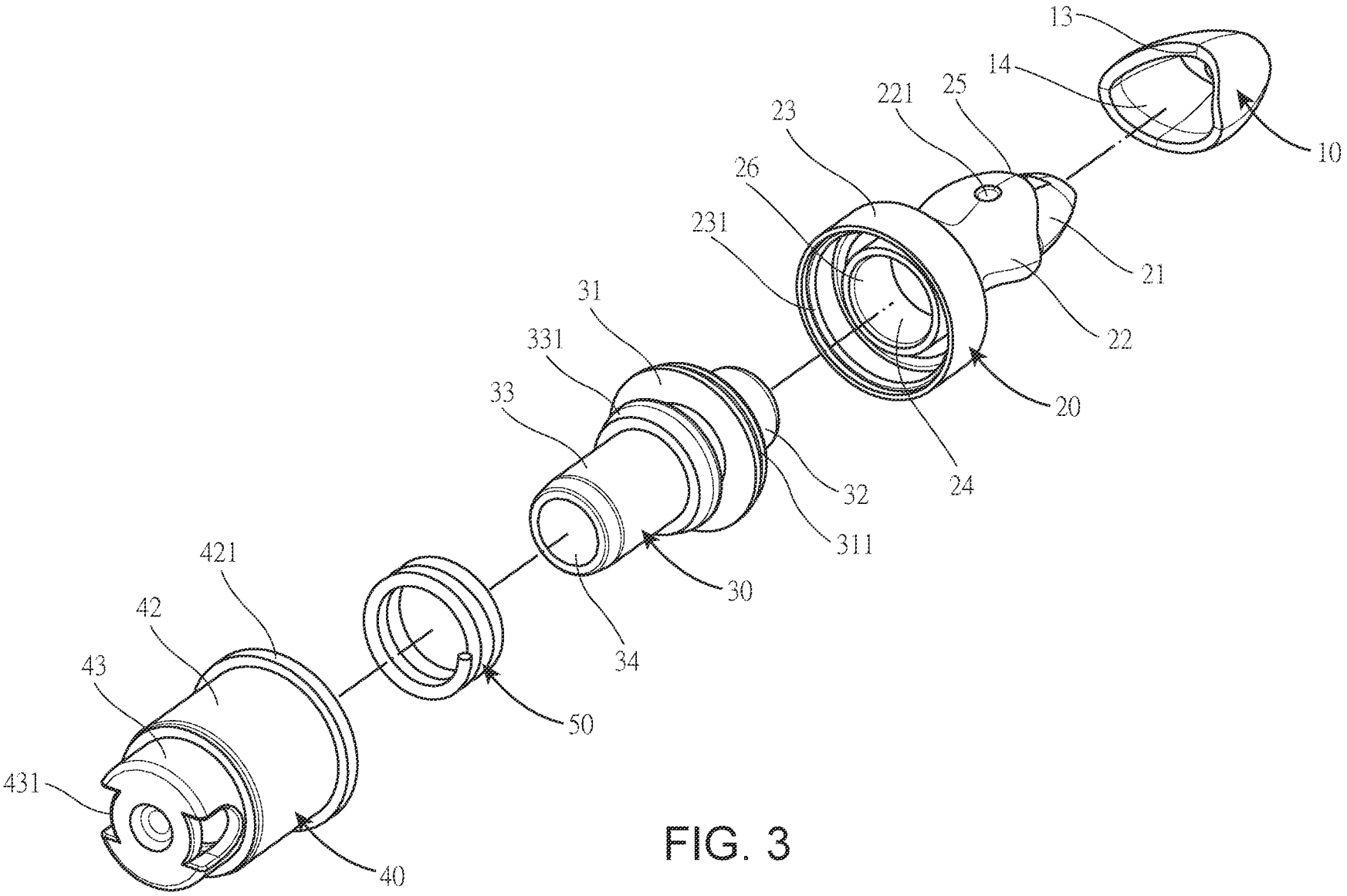
FIG. 3 is another exploded view of the metal application head device.
Figure 4:
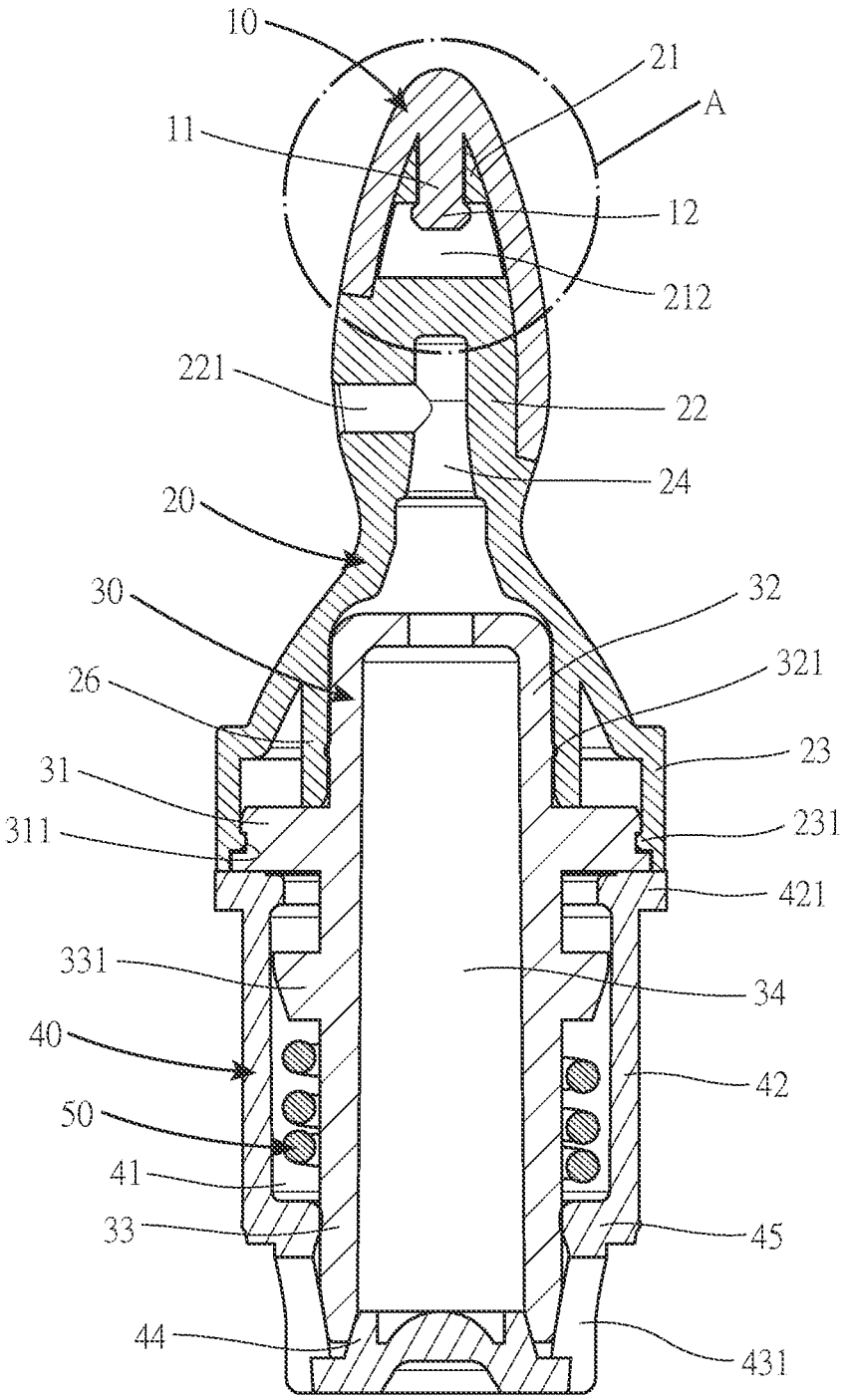
FIG. 4 is a longitudinal section view of FIG. 1.
Figure 5:
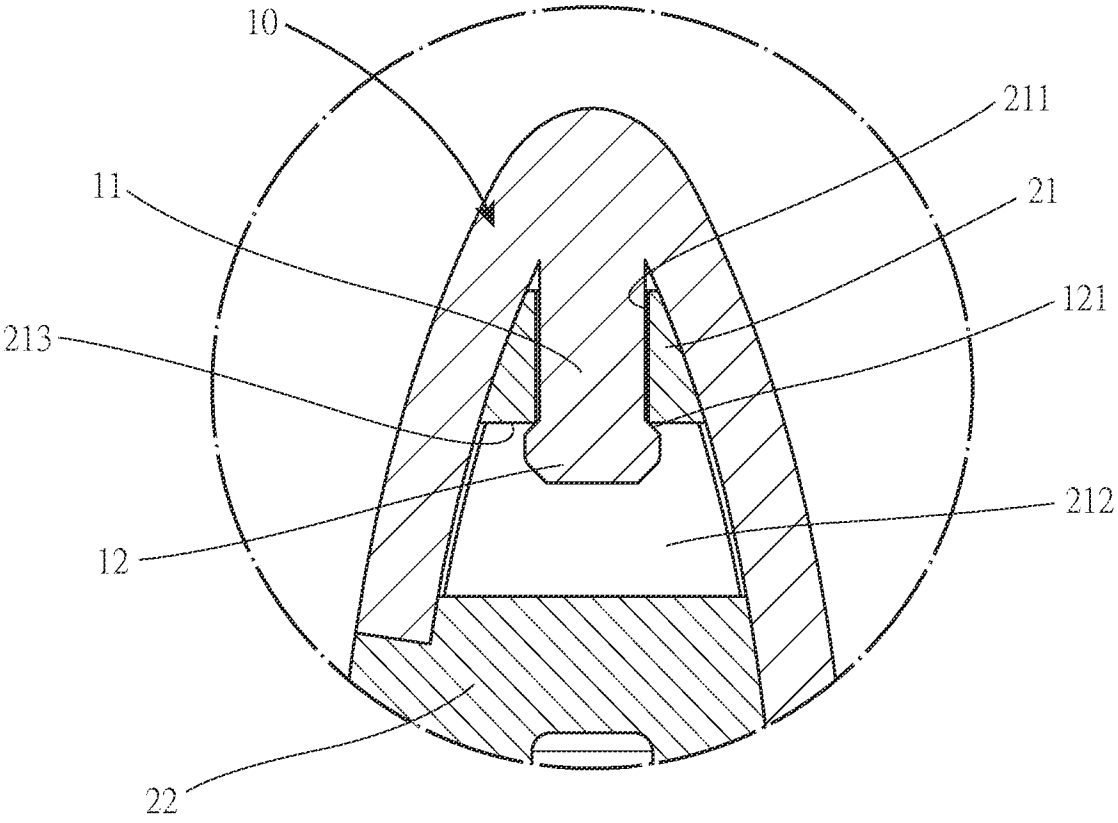
FIG. 5 is a detailed view of the area in circle A of FIG. 4.

Referring to FIGS. 1 to 5, a metal application head device of a cosmetic container in accordance with a first preferred embodiment of the invention comprises the following components as discussed in detail below.

An application head 10 is formed by punching a metal sheet and includes an internal space 14, a positioning rod 11 at an inner end, an enlargement 12 at an end of the positioning rod 11, an annular, inclined surface 121 between the positioning rod 11 and the enlargement 12, and a concave member 13 at an open end opposing the positioning rod 11.

A discharging unit 20 is made of plastic and formed integrally. The discharging unit 20 includes a joining section 21, a discharging section 22 and a fastening section 23. The joining section 21 is fitted in the space 14 and includes a through hole 211 through a top, a positioning opening 212 under the through hole 211 and communicating with the through hole 211, and a shoulder 213 between the positioning opening 212 and the through hole 211. The positioning rod 11 passes through the through hole 211 with the annular, inclined surface 121 urging against the shoulder 213, An axial channel 24 is provided through the discharging section 22. A shoulder member 25 extending forward out of the discharging section 22 is provided. The concave member 13 is complimentarily secured to the shoulder member 25. The discharging section 22 includes a transverse outlet 221 communicating with the axial channel 24. The fastening section 23 includes an annular rib 231 on an inner surface. A bossed hole 26 is provided in the fastening section 23.

A plunger 30 includes an intermediate, annular flange 31 having an annular groove 311 on an outer surface with the annular rib 231 disposed therein, a hollow, cylindrical, front extension 32 disposed in the bossed hole 26 and having an annular ridge 321 on an outer surface urging against an inner surface of the bossed hole 26, a cylindrical, rear extension 33 having an annular member 331 on an outer surface adjacent to the annular flange 31, and an axial tunnel 34 through the plunger 30 and communicating with the axial channel 24.

A sleeve 40 includes a cylindrical member 42 having a front rim 421 extending outward and urging against both the fastening section 23 and the annular flange 31, an internal space 41 provided in the cylindrical member 42 with the rear extension 33 and the annular member 331 disposed therein, a rear extending member 43 having two inlets 431 on two sides respectively, a conic, annular member 44 disposed in a rear end of the rear extending member 43 and urging against a rear end of the rear extension 33, and a limiting shoulder 45 between the cylindrical member 42 and the rear extending member 43 and urging against the rear extension 33.

A torsion spring 50 is disposed on the rear extension 33 and biased between the annular member 331 and the limiting shoulder 45.

Figure 6:
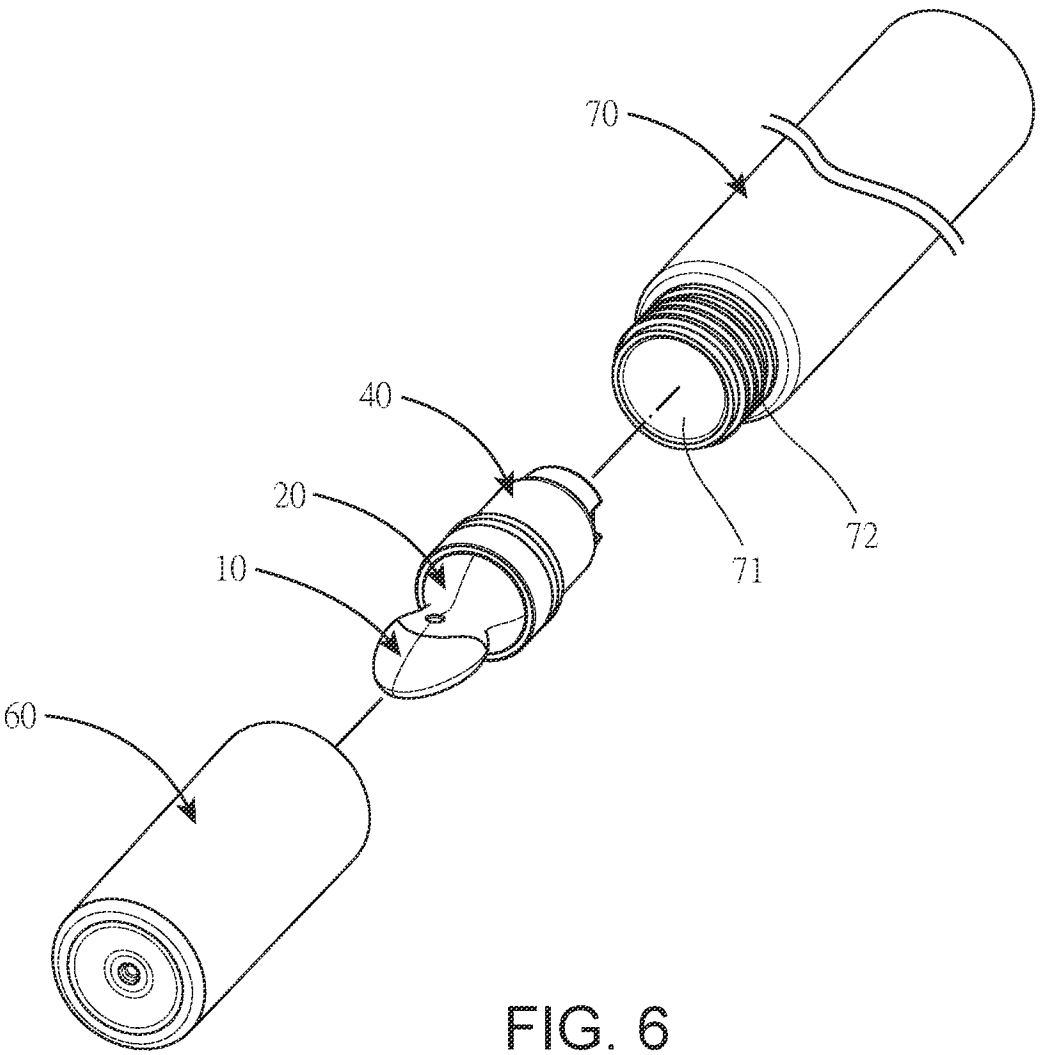
FIG. 6 is an exploded view of a cap, the metal application head device and a container of a cosmetic container.
Figure 7:
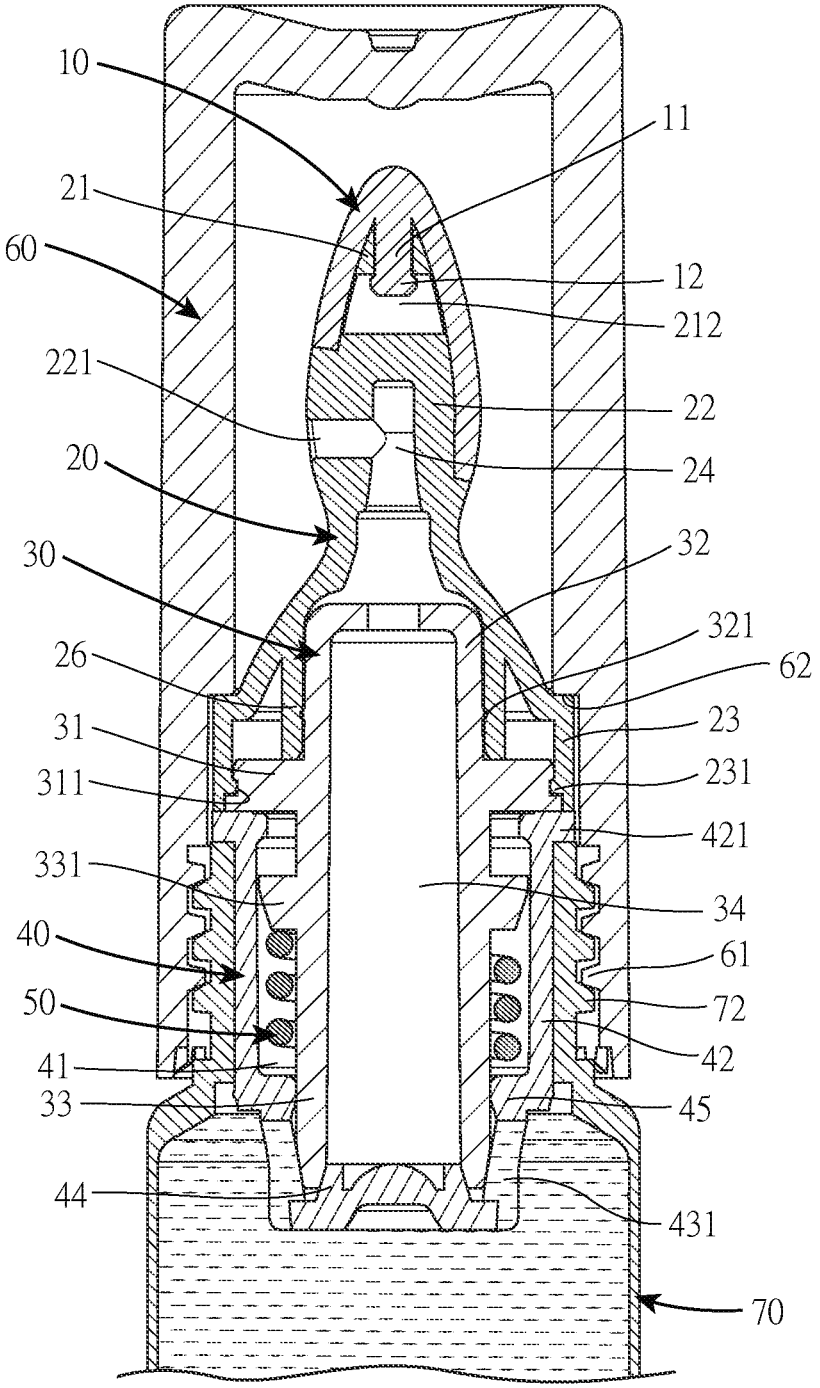
FIG. 7 is a longitudinal sectional view of a portion of the assembled cap, the metal application head device and the container in FIG. 6.
Figure 8:
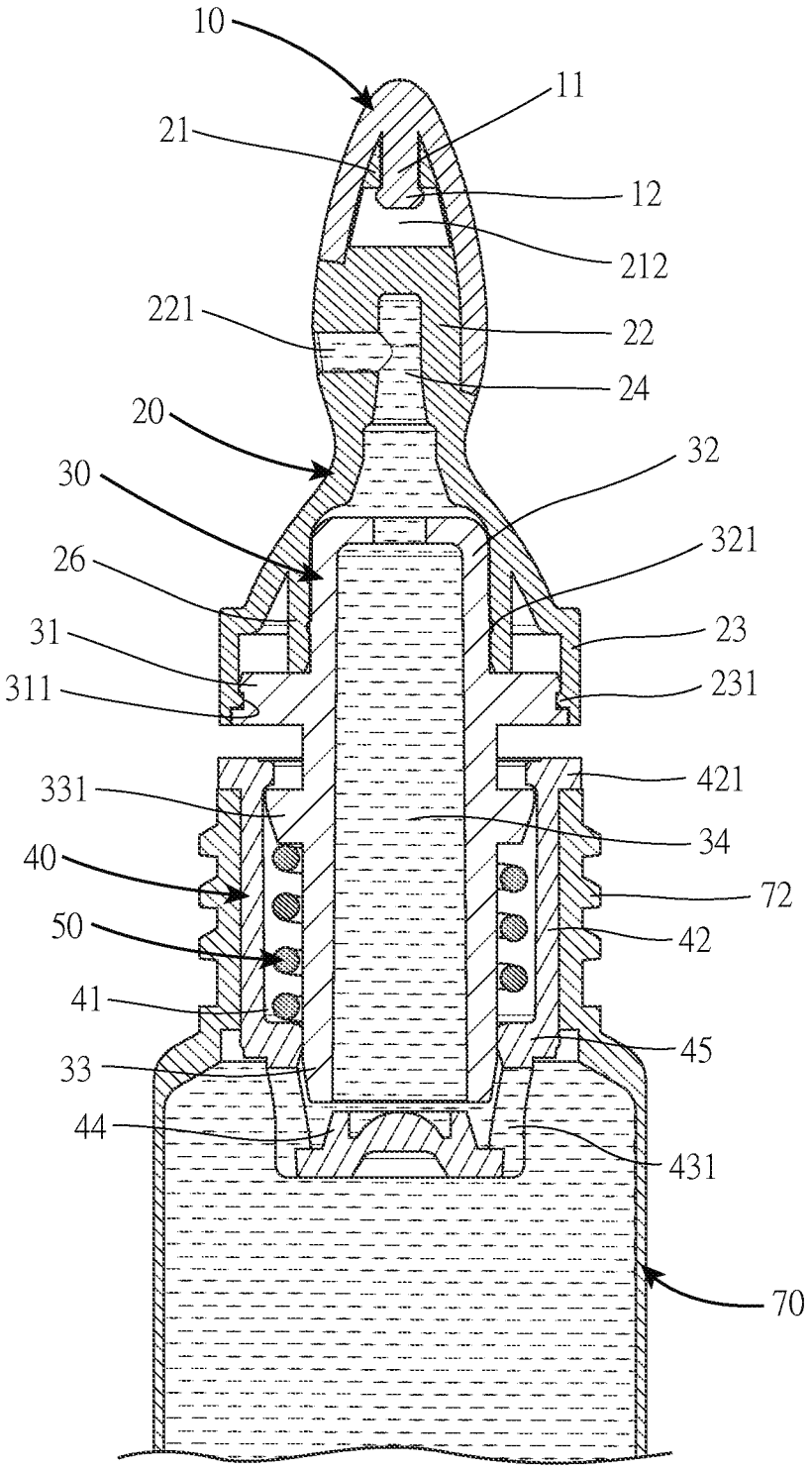
FIG. 8 is a view similar to FIG. 7 with the cap removed and cosmetic liquid flowing through the metal application head device to be discharged.

Referring to FIGS. 6 to 8, a cosmetic container incorporating the application head device of the first preferred embodiment is shown. In conjunction with FIGS. 1 to 5, the cosmetic container comprises the application head device, a cap 60, and a container 70 containing a cosmetic liquid. The cap 60 includes an internally threaded member 61 on an inner surface and an internal shoulder 62. The container 70 includes an externally threaded neck 72 and an opening 71 through the externally threaded neck 72. The externally threaded neck 72 is secured to the internally threaded member 61 in condition of storage of the cosmetic container in which the application head 10 and the discharging unit 20 are enclosed therein, the internal shoulder 62 urges against the fastening section 23, the sleeve 40 is disposed in the opening 71, and the front rim 421 urges against a top edge of the opening 71. Cosmetic liquid stored in the container 70 may flow from the inlets 431 through the axial tunnel 34 and the axial channel 24.

In use, an individual may counterclockwise rotate the cap 60 to remove the cap 60 from the container 70, i.e., the cosmetic container being open. In the open configuration, the energized torsion spring 50 expands to exert an elastic force to push the annular member 331 upward. And in turn, the rear extension 33 is disengaged from the conic, annular member 44 and the front rim 421 is disengaged from both the fastening section 23 and the annular flange 31. As a result, the cosmetic liquid in the container 70 flows from the inlets 431 to the outlet 221 through the axial tunnel 34 and the axial channel 24. The individual may use the application head 10 to apply the discharged cosmetic liquid to the body part.

After use, the individual may put the cap 60 on the container 70 and clockwise rotate the cap 60 to secure the internally threaded member 61 to the externally threaded neck 72, i.e., the cosmetic container being closed. In the closed configuration, the internal shoulder 62 urges against the fastening section 23. And in turn, both the fastening section 23 and the annular flange 31 urge against the front rim 421, the torsion spring 50 is compressed by the annular member 331 to urge the rear extension 33 against the conic, annular member 44, and the inlets 431 are closed. As a result, the cosmetic liquid in the container 70 is stopped from flowing out of the container 70.

Figure 9:
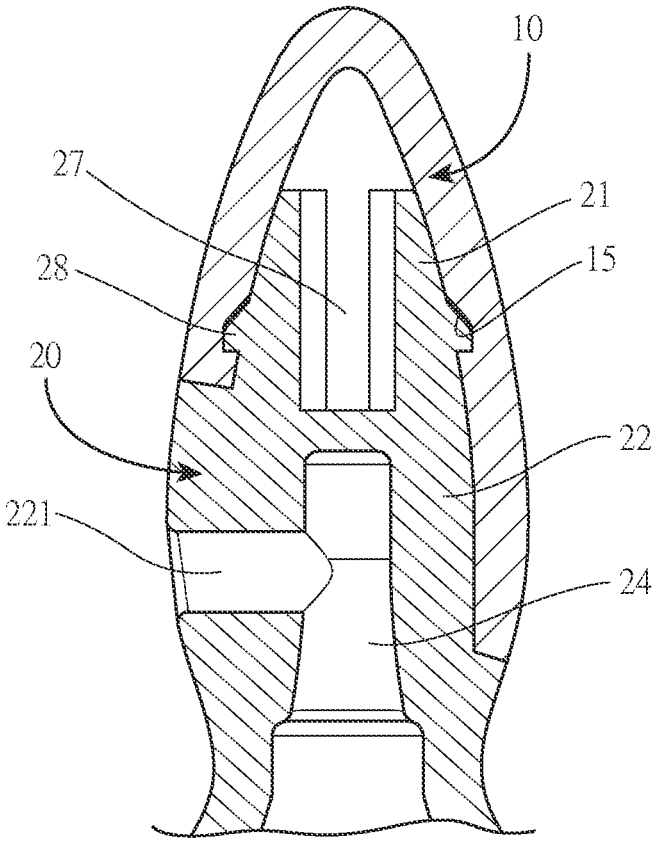
FIG. 9 is a longitudinal sectional view of a metal application head device of a cosmetic container according to a second preferred embodiment of the invention.

Referring to FIG. 9, a metal application head device of cosmetic container in accordance with a second preferred embodiment of the invention is shown. The characteristics of the second preferred embodiment are substantially the same as that of the first preferred embodiment except the following:

In conjunction with FIGS. 1 to 5, the positioning rod 11 and the enlargement 12 are eliminated from the application head 10. The positioning opening 212 and the through hole 211 are eliminated from the joining section 21. The application head 10 includes an annular groove 15 on an inner surface adjacent to an open end. An axial well 27 is provided in the joining section 21. An annular projection 28 is provided on an outer surface of the joining section 21 and disposed in the annular groove 15 when the cosmetic container is closed. Thus, the fastening of the application head 10 and the discharging unit 20 is reliable.

In the closed configuration of the cosmetic container, the application head 10 and the discharging unit 20 are secured together. The joining section 21 contracts toward the axial well 27 due to flexibility. As a result, the annular projection 28 can be easily disposed in the annular groove 15.

Figure 10:
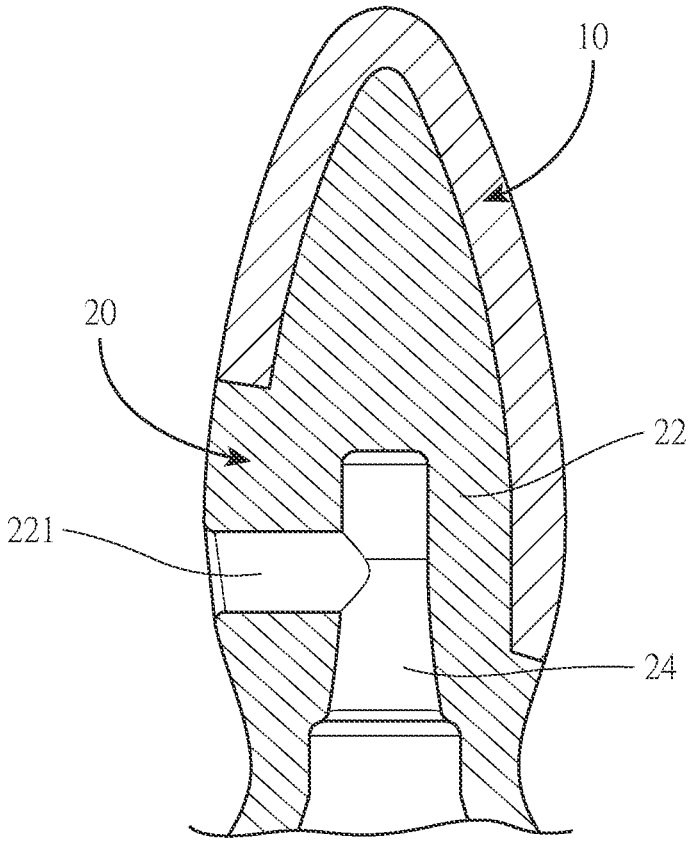
FIG. 10 is a longitudinal sectional view of a metal application head device of a cosmetic container according to a third preferred embodiment of the invention.

Referring to FIG. 10, a metal application head device of a cosmetic container in accordance with a third preferred embodiment of the invention is shown. The characteristics of the third preferred embodiment are substantially the same as that of the second preferred embodiment except the following:

In conjunction with FIG. 9, the annular groove 15 is eliminated from the application head 10. The axial well 27 and the annular projection 28 are eliminated from the joining section 21. The application head 10 and the discharging unit 20 are fastened together by means of two times of injection molding. The application head 10 having an internal space 14 is formed by punching a metal sheet. Size of the application head 10 is more precise so that a perfect fit between the application head 10 and the discharging unit 20 is made possible. Further, an outer surface of the discharging unit 20 is smooth.

While the invention has been described in terms of preferred embodiments, those skilled in the art will recognize that the invention can be practiced with modifications within the spirit and scope of the appended claims.

What is claimed is:

1. A metal application head device of a cosmetic container, comprising:

a metal application head is formed by punching a metal sheet, including an internal space, a positioning rod at an inner end, an enlargement at an end of the positioning rod, and an annular inclined surface between the positioning rod and the enlargement;

a plastic discharging unit, the plastic discharging unit including a joining section, a discharging section, and a fastening section wherein the joining section is fitted in the internal space of the metal application head and includes a through hole through a top, a positioning opening under the through hole and communicating with the through hole, and a shoulder between the positioning opening and the through hole, the discharging section includes an axial channel and a transverse outlet communicating with the axial channel, the fastening section includes an internal bossed hole, and the positioning rod passes through the through hole with the annular inclined surface urging against the shoulder;

a plunger including an intermediate annular flange, a hollow cylindrical front extension disposed in the bossed hole, an axial tunnel through the plunger and communicating with the axial channel, and a cylindrical rear extension;

a sleeve including a cylindrical member having a front rim extending outward and urging against both the fastening section and the intermediate annular flange, an internal space disposed in the cylindrical member with the cylindrical rear extension disposed therein, and a rear extending member having at least one transverse inlet; and a biasing member disposed on the cylindrical rear extension.

2. The metal application head device of claim 1, wherein the cylindrical rear extension includes an annular member on an outer surface adjacent to the intermediate annular flange, and a limiting shoulder between the cylindrical member and the rear extending member, the limiting shoulder urging against the cylindrical rear extension; and the biasing member is biased between the annular member and the limiting shoulder.

3. The metal application head device of claim 1, further comprising a conic annular member disposed in a rear end of the rear extending member and urging against a rear end of the cylindrical rear extension.

4. The metal application head device of claim 1, wherein the hollow cylindrical front extension includes an annular ridge on an outer surface, the annular ridge being adjacent to the intermediate annular flange and urging against an inner surface of the bossed hole.

5. The metal application head device of claim 1, wherein the metal application head further comprises a concave member at an open end, wherein the plastic discharging unit further comprises a shoulder member extending forward out of the discharging section, and wherein the concave member is complimentarily secured to the shoulder member.

6. The metal application head device of claim 1, wherein the fastening section further comprises an annular rib on an inner surface, and wherein the intermediate annular flange includes an annular groove on an outer surface with the annular rib disposed therein.

7. A metal application head device of a cosmetic container, comprising:

a metal application head is formed by punching a metal sheet, the metal application head including an internal space;

a plastic discharging unit, the plastic discharging unit including a joining section, a discharging section, and a fastening section, wherein the joining section is fitted in the internal space of the metal application head, the discharging section includes an axial channel and a transverse outlet communicating with the axial channel, and the fastening section includes an internal bossed hole;

a plunger including an intermediate annular flange, a hollow cylindrical front extension disposed in the bossed hole, an axial tunnel through the plunger and communicating with the axial channel, and a cylindrical rear extension;

a sleeve including a cylindrical member having a front rim extending outward and urging against both the fastening section and the intermediate annular flange, an internal space disposed in the cylindrical member with the cylindrical rear extension disposed therein, and a rear extending member having at least one transverse inlet; and a biasing member disposed on the cylindrical rear extension.

8. The metal application head device of claim 7, wherein the metal application head further comprises an annular groove on an inner surface adjacent to an open end, and wherein the joining section includes an axial well and an annular projection on an outer surface, the annular projection being disposed in the annular groove.

9. The metal application head device of claim 7, wherein the metal application head and the plastic discharging unit are fastened together by means of two times of injection molding.

10. The metal application head device of claim 7, wherein the cylindrical rear extension includes an annular member on an outer surface adjacent to the intermediate annular flange, and a limiting shoulder between the cylindrical member and the rear extending member, the limiting shoulder urging against the cylindrical rear extension, and the biasing member is biased between the annular member and the limiting shoulder.

11. The metal application head device of claim 7, further comprising a conic annular member disposed in a rear end of the rear extending member and urging against a rear end of the cylindrical rear extension.

12. The metal application head device of claim 7, wherein the hollow cylindrical front extension includes an annular ridge on an outer surface, the annular ridge being adjacent to the intermediate annular flange and urging against an inner surface of the bossed hole.

13. The metal application head device of claim 7, wherein the metal application head further comprises a concave member at an open end, wherein the plastic discharging unit further comprises a shoulder member extending forward out of the discharging section, and wherein the concave member is complimentarily secured to the shoulder member.

14. The metal application head device of claim 7, wherein the fastening section further comprises an annular rib on an inner surface, and wherein the intermediate annular flange includes an annular groove on an outer surface with the annular rib disposed therein.

* * * * *